US008655224B2

(12) United States Patent
Yoshino et al.

(10) Patent No.: US 8,655,224 B2
(45) Date of Patent: Feb. 18, 2014

(54) IMAGE FORMING APPARATUS

(75) Inventors: Naoto Yoshino, Ebina (JP); Masaaki Tokunaga, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 248 days.

(21) Appl. No.: 12/787,676

(22) Filed: May 26, 2010

(65) Prior Publication Data

US 2011/0110686 A1 May 12, 2011

(30) Foreign Application Priority Data

Nov. 10, 2009 (JP) ..... 2009-257295

(51) Int. Cl.
*G03G 15/08* (2006.01)

(52) U.S. Cl.
USPC ..... 399/121; 399/110; 399/162; 399/297; 399/302

(58) Field of Classification Search
USPC ..... 399/121, 302, 308, 13, 110, 162, 297
See application file for complete search history.

(56) References Cited

U.S. PATENT DOCUMENTS

| | | | | |
|---|---|---|---|---|
| 2003/0103780 | A1* | 6/2003 | Hoashi | 399/167 |
| 2004/0228653 | A1* | 11/2004 | Yoshino | 399/121 |
| 2005/0008393 | A1* | 1/2005 | Kuma et al. | 399/110 |
| 2007/0286649 | A1 | 12/2007 | Kawasumi et al. | |
| 2009/0123178 | A1* | 5/2009 | Suzuki et al. | 399/121 |
| 2010/0150607 | A1* | 6/2010 | Kaneyama | 399/121 |

FOREIGN PATENT DOCUMENTS

| | | | | |
|---|---|---|---|---|
| JP | A-10-104998 | | 4/1998 | |
| JP | A-2000-231231 | | 8/2000 | |
| JP | B2-3559033 | | 5/2004 | |
| JP | 2005309036 | A * | 11/2005 | G03G 15/16 |
| JP | A-2006-267165 | | 10/2006 | |
| JP | A-2007-304500 | | 11/2007 | |

OTHER PUBLICATIONS

English translation of an Office Action dated Aug. 20, 2013 issued in Japanese Patent Application No. 2009-257295.

* cited by examiner

*Primary Examiner* — David Gray
*Assistant Examiner* — Francis Gray
(74) *Attorney, Agent, or Firm* — Oliff PLC

(57) ABSTRACT

An image forming apparatus includes: an image carrier; an intermediate transfer unit including an intermediate transfer body onto which an image on the image carrier is transferred, and plural rotation members around which the intermediate transfer body is wound, each rotation member rotating around a rotation axis, the intermediate transfer unit detachably attached, in the rotation axis direction, to an apparatus main body; a secondary transfer unit that makes contact with and separates from the intermediate transfer body, the secondary transfer unit provided at an opposite side of the rotation members across the intermediate transfer body; a positioning unit that, when the intermediate transfer unit is attached to the apparatus main body, positions the intermediate transfer unit in the secondary transfer unit side at least at two points differently located in the rotation axis direction; and a securing unit that secures the intermediate transfer unit to the apparatus main body.

11 Claims, 6 Drawing Sheets

IMAGE FORMING APPARATUS

CROSS REFERENCE TO RELATED APPLICATIONS

This application is based on and claims priority under 35 USC §119 from Japanese Patent Application No. 2009-257295 filed Nov. 10, 2009.

BACKGROUND

1. Technical Field

The present invention relates to an image forming apparatus.

2. Related Art

Nowadays, as an image forming apparatus, an apparatus is proposed such that plural image forming units, each including a photoconductive drum, a developing device and so forth, are arranged in a tandem configuration and a toner image of predetermined colors formed by each of the image forming units is primary-transferred onto an intermediate transfer body and then secondary-transferred onto a recording medium.

SUMMARY

According to an aspect of the present invention, there is provided an image forming apparatus including: an image carrier that carries an image; an intermediate transfer unit including a belt-like intermediate transfer body onto which the image formed on the image carrier is transferred, and plural rotation members around which the intermediate transfer body is wound, each of the plural rotation members rotating around a rotation axis, the intermediate transfer unit being detachably attached, in a direction of the rotation axis of each of the plural rotation members, to an apparatus main body; a secondary transfer unit that transfers the image on the intermediate transfer body onto a recording medium and makes contact with and separates from the intermediate transfer body, the secondary transfer unit being provided at an opposite side of the plural rotation members with the intermediate transfer body interposed therebetween; a positioning unit that, when the intermediate transfer unit is attached to the apparatus main body, positions the intermediate transfer unit in the secondary transfer unit side at least at two points differently located in the rotation axis direction of the plural rotation members; and a securing unit that secures the intermediate transfer unit positioned by the positioning unit to the apparatus main body.

BRIEF DESCRIPTION OF THE DRAWINGS

Exemplary embodiment of the present invention will be described in detail based on the following figures, wherein.

DETAILED DESCRIPTION

Hereinafter, an exemplary embodiment of the present invention is described in detail with reference to the accompanying drawings.

Figure 1:
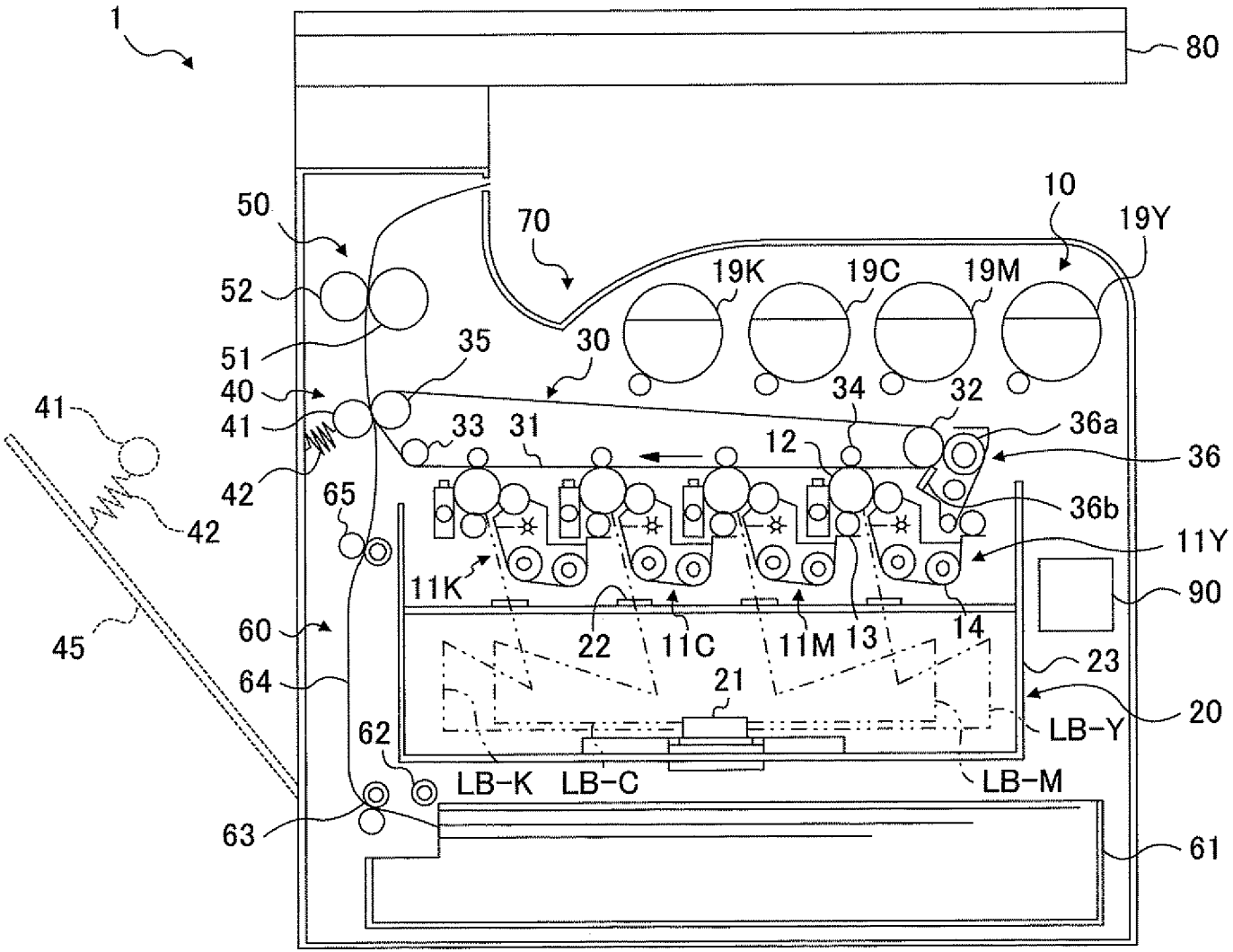
FIG. 1 is a diagram showing a schematic configuration of an image forming apparatus to which an exemplary embodiment of the present invention is applied.

FIG. 1 is a diagram showing a schematic configuration of an image forming apparatus 1 to which the exemplary embodiment of the present invention is applied.

The image forming apparatus 1 includes: an image forming unit 10 that forms an image on a recording medium (hereinafter, representatively, referred to as a "sheet" in some cases); a sheet supplying unit 60 that supplies a sheet to the image forming unit 10; and a sheet stacking unit 70 on which the sheets each including an image formed by the image forming unit 10 are stacked. The image forming apparatus 1 also includes: an image reader 80 that reads out an image of an original; and a controller 90 that controls an operation of each component.

The image forming unit 10 includes four image formation units 11Y, 11M, 11C and 11K of yellow (Y), magenta (M), cyan (C) and black (K) that are arranged in parallel at certain intervals. Each of the image formation units 11 includes: a photoconductive drum 12; a charging device 13 that uniformly charges the surface of the photoconductive drum 12; and a developing device 14 that develops an electrostatic latent image with predetermined color component toners and thus visualizes the image, the electrostatic latent image being formed by a later-described optical system unit 20 using laser irradiation. In addition, the image forming unit 10 is provided with toner cartridges 19Y, 19M, 19C and 19K that supply the color toners to the developing devices 14 of the image formation units 11Y, 11M, 11C and 11K, respectively. Then, the optical system unit 20 that emits a laser beam to the photoconductive drums 12 of the image formation units 11Y, 11M, 11C and 11K is arranged below the image formation units 11Y, 11M, 11C and 11K.

Figure 3:
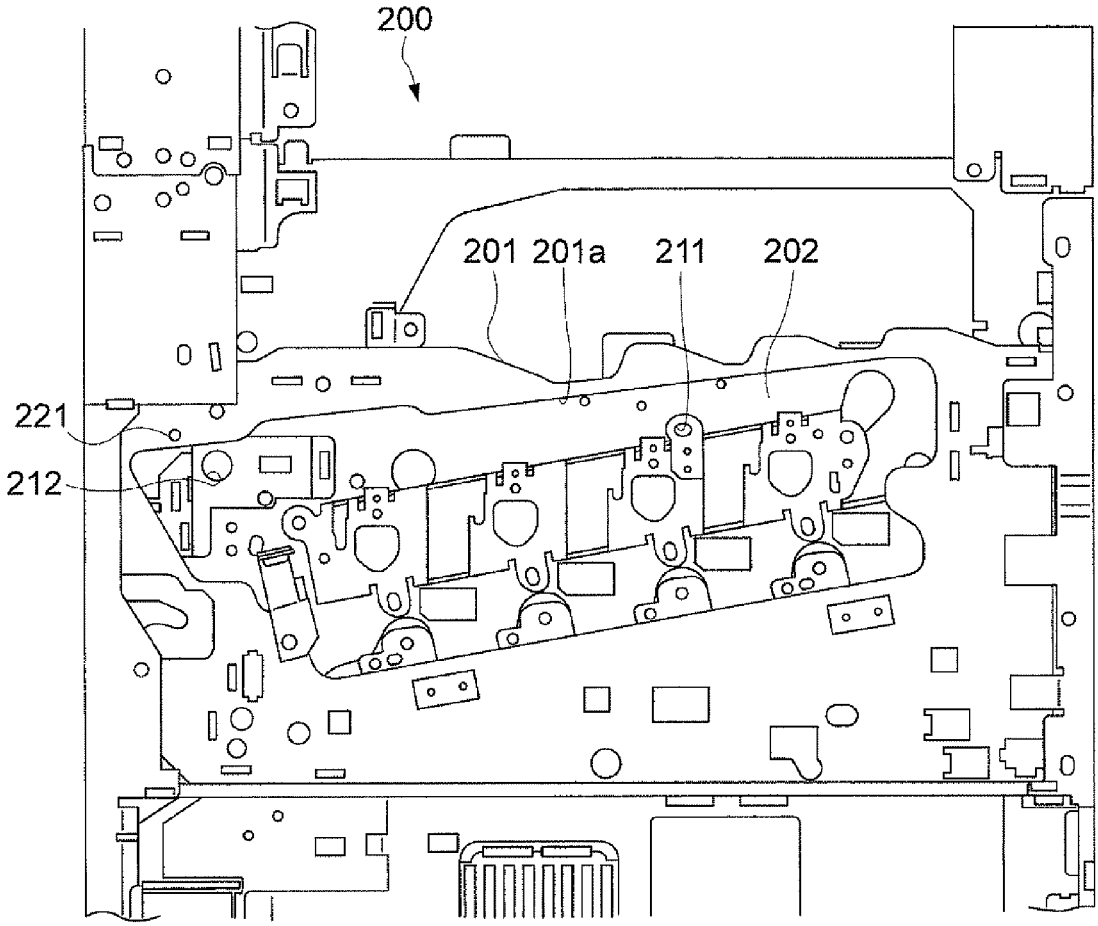
FIG. 3 is a diagram showing an external appearance of a main body frame.

In addition, the image forming unit 10 includes: an intermediate transfer unit 30 that transfers the color toner images formed on the photoconductive drums 12 of the respective image formation units 11Y, 11M, 11C and 11K, onto an intermediate transfer belt 31 in a multi-layered manner; a secondary transfer unit 40 as an example of a secondary transfer unit that transfers, onto a sheet, the toner images formed while being superimposed one on top of another on the intermediate transfer unit 30; a fixing device 50 that fixes the formed toner images onto the sheet by applying heat and pressure thereto; and a front cover 37 (refer to FIG. 6) that secures the intermediate transfer unit 30 to a main body frame 200 (refer to FIG. 3).

The optical system unit 20 includes a polygon mirror 21, glass-made windows 22, and a rectangular parallelepiped frame 23 in addition to not-shown semiconductor lasers and a modulator. The polygon mirror 21 deflects and scans laser beams (LB-Y, LB-M, LB-C and LB-K) emitted from the semiconductor lasers. The windows 22 allow the laser beams to pass therethrough. The frame 23 encloses the component members.

The intermediate transfer unit 30 in the present exemplary embodiment includes: the intermediate transfer belt 31 as an example of an intermediate transfer body; a drive roller 32, as an example of a non-facing member not facing a later-described secondary transfer roller 41 via the intermediate transfer belt 31, that drives the intermediate transfer belt 31; and a tension roller 33 that provides a constant tension to the intermediate transfer belt 31. Moreover, the intermediate transfer unit 30 includes: multiple primary transfer rollers 34 (four rollers in this exemplary embodiment) that face the respective photoconductive drums 12 with the intermediate transfer belt 31 interposed therebetween and transfer the toner images formed on the photoconductive drums 12 onto the intermediate transfer belt 31; and a backup roller 35 as an example of a facing member that is provided facing the later-described secondary transfer roller 41 with the intermediate transfer belt 31 interposed therebetween.

The intermediate transfer belt 31 is wound around the multiple roll members including the drive roller 32, the tension roller 33, the multiple primary transfer rollers 34 and the backup roller 35 with the constant tension applied thereto so that its length in a direction in which the multiple primary transfer rollers 34 are arranged may be longer than its length in the direction orthogonal to a plane including the rotation axes of the multiple primary transfer rollers 34. The intermediate transfer belt 31 is circularly driven by the drive roller 32 at a predetermined velocity in the direction indicated by an arrow, the drive roller 32 rotationally driven by a drive motor (not shown). As the intermediate transfer belt 31, one that is formed by rubber or resin is used, for example.

Moreover, the intermediate transfer unit 30 includes a cleaning device 36 that removes a residual toner and the like existing on the intermediate transfer belt 31. The cleaning device 36 includes a cleaning brush 36*a* and a cleaning blade 36*b*, and removes the residual toner, paper debris and the like from the surface of the intermediate transfer belt 31 after a transfer process of toner images is ended.

As described above, the intermediate transfer unit 30 has a thin and long shape in which the intermediate transfer belt 31 is wound around the drive roller 32, the tension roller 33 and the like so as to have a thin and long shape in the arrangement direction of the multiple primary transfer rollers 34. In addition, in the intermediate transfer unit 30, the backup roller 35 is arranged at one end in the longitudinal direction of the intermediate transfer belt 31 which is wound around the rollers to have the thin and long shape, and the cleaning device 36 is arranged at the other end thereof in the longitudinal direction.

Then, the front cover 37 (refer to FIG. 6) is arranged at the front side of the intermediate transfer unit 30. As will be later described in more detail, the front cover 37, as an example of a securing unit, secures the intermediate transfer unit 30 to the main body frame 200 that forms an apparatus main body of the image forming apparatus 1 in the present exemplary embodiment, while covering the part located at the front side of the intermediate transfer unit 30.

The secondary transfer unit 40 includes: a secondary transfer roller 41 that is provided at a secondary transfer position and presses the backup roller 35 with the intermediate transfer belt 31 interposed therebetween to secondary-transfer the image onto the sheet; and a coil spring 42 that urges the secondary transfer roller 41. The secondary transfer roller 41 is attached to a side cover 45, which is provided to the left side of the image forming apparatus as viewed in FIG. 1, via the coil spring 42. The side cover 45 releases a transport path 64, which will be described later, by transition from a closed state shown by a solid line in FIG. 1, through a rotation in the counterclockwise direction, to an opened state shown by a broken line in the figure. By rotating the side cover 45 in the closing direction from the opened state where the transport path 64 is released, the secondary transfer roller comes to press the backup roller 35. Then the side cover 45 is attached to the main body frame 200 so that a distance between the rotation axis of the secondary transfer roller 41 and the rotation axis of the backup roller 35 becomes a predetermined one.

The fixing device 50 fixes the images (toner images) secondary-transferred on the sheet by the intermediate transfer unit 30 to the sheet by a heat-fixing roller 51 and a pressure roller 52 using heat and pressure.

The sheet supplying unit 60 includes: a sheet housing unit 61 that houses sheets on which images are to be recorded; a nudger roller 62 that takes sheets from the sheet housing unit 61 and then supplies the sheets to the transport path 64; and a feed roller 63 that separates, one by one, the sheets supplied from the nudger roller 62 and then transports the sheets. In addition, the sheet supplying unit 60 includes: the transport path 64 that transports, towards the secondary transfer region, the sheets separated one by one by the feed roller 63; and registration rollers 65 that transport the sheet transported via the transport path 64 toward the secondary transfer region according to the secondary transfer timing.

The image forming apparatus 1 configured in the above-described manner operates as follows.

An image of an original that is read out by the image reader 80, or image data received from a not-shown personal computer or the like is subjected to predetermined image processing. The image data subjected to the image processing is then converted into coloring material continuous tone data of four colors of yellow (Y), magenta (M), cyan (C) and black (K) and then outputted to the optical system unit 20.

The optical system unit 20 outputs the laser beams emitted from the semiconductor lasers (not-shown) to the polygon mirror 21 via an f-θ lens (not shown) in accordance with the inputted coloring material continuous tone data. In the polygon mirror 21, the incident laser beams are modulated in accordance with the continuous tone data of the respective colors, and then deflected and scanned. The polygon mirror 21 then directs the laser beams to the photoconductive drums 12 of the image formation units 11Y, 11M, 11C and 11K via a not-shown imaging lens and not-shown multiple mirrors.

In the photoconductive drums 12 of the image formation units 11Y, 11M, 11C and 11K, their surfaces charged by the charging devices 13 are scanned and exposed, and thereby, electrostatic latent images are formed. The formed electrostatic latent images are developed as toner images of the respective colors of yellow (Y), magenta (M), cyan (C) and black (K) in the image formation units 11Y, 11M, 11C and 11K, respectively. The toner images formed on the photoconductive drums 12 of the image formation units 11Y, 11M, 11C and 11K are transferred in a multi-layered manner onto the intermediate transfer belt 31 that is an intermediate transfer body.

Meanwhile, in the sheet supplying unit 60, the nudger roller 62 rotates according to the timing of image formation to take the sheets housed in the sheet housing unit 61. Then, after the sheets are separated one by one by the feed roller 63, the sheet is transported to the registration rollers 65 via the transport path 64, and is once stopped there. Thereafter, the registration rollers 65 rotate according to the moving timing of the intermediate transfer belt 31 on which the toner images are formed. Then, the sheet is transported to the secondary transfer region formed by the backup roller 35 and the secondary transfer roller 41. The toner images obtained by forming the toner images of the four colors in a multi-layered manner are sequentially transferred onto the sheet in the slow scan direction by use of a pressure bonding force and a predetermined electric field, the sheet being transported upward in the secondary transfer region. Then, the sheet on which the color toner images are transferred is outputted after undergoing the fixing process performed by the fixing device 50 using heat and pressure. The sheet is then stacked in the sheet stacking unit 70.

Next, the intermediate transfer unit 30 in the exemplary embodiment, which is configured and operates as described above, will be described in more detail.

Figure 2:
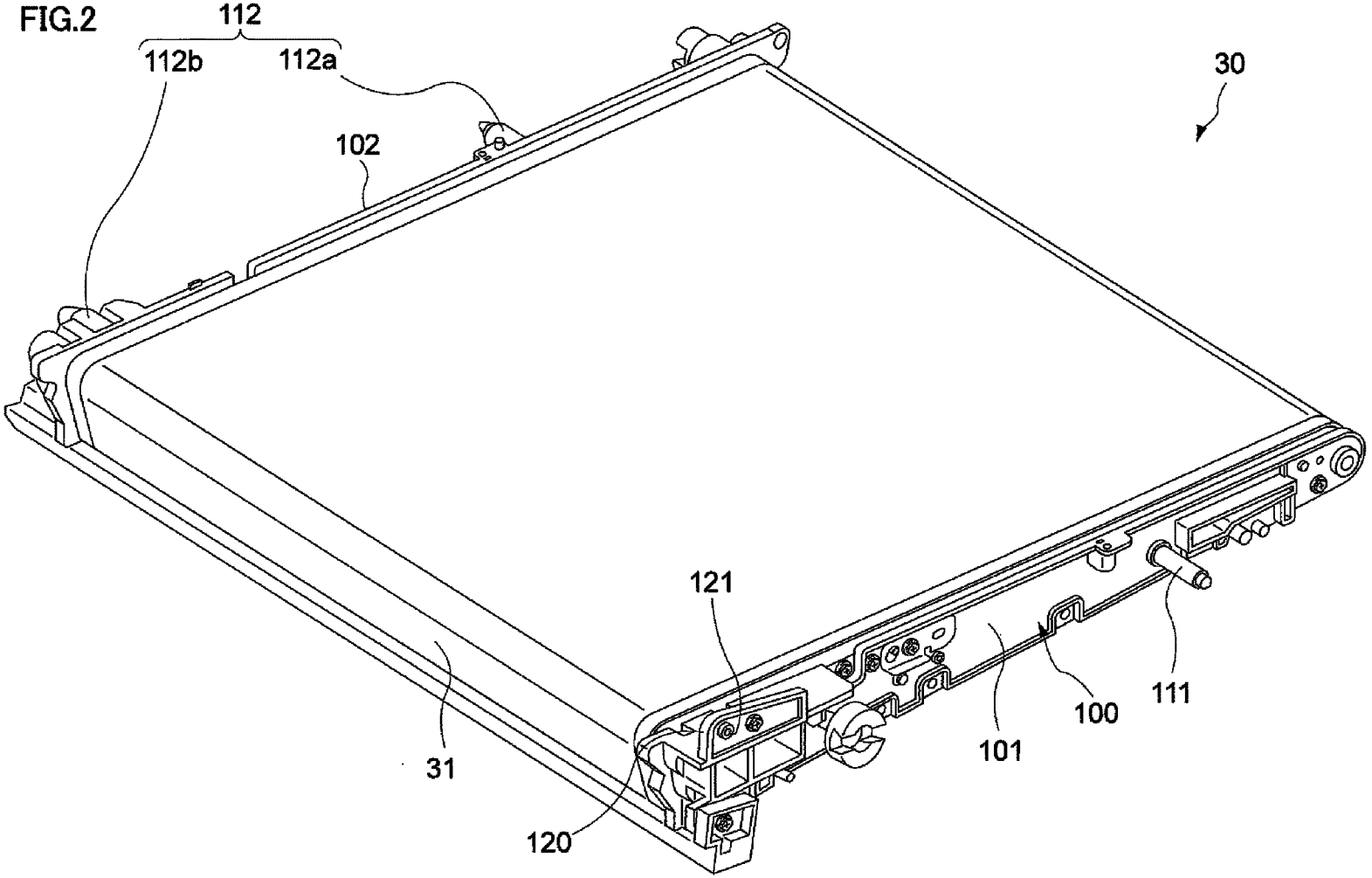
FIG. 2 is a perspective view of an intermediate transfer unit.

FIG. 2 is a perspective view of the intermediate transfer unit 30. The cleaning device 36 is omitted in FIG. 2.

The intermediate transfer unit 30 includes the drive roller 32, the tension roller 33, the primary transfer rollers 34 and the backup roller 35 as described above. The intermediate transfer unit 30 further includes a support member 100 that supports the aforementioned rollers at their both sides in the rotation axis direction of the rollers (hereinafter, simply referred to as a "rotation axis direction" in some cases). The support member 100 has a front-side support member 101 provided at the front side of the intermediate transfer unit 30, and a backside support member 102 provided at the backside thereof as viewed in FIG. 1. The support member 100 rotatably supports the drive roller 32, the tension roller 33, the multiple primary transfer rollers 34 and the backup roller 35 by the front-side support member 101 and the backside support member 102. Then, the intermediate transfer belt 31 is wound around the drive roller 32, the tension roller 33, the primary transfer rollers 34 and the backup roller 35. The intermediate transfer belt 31 is circularly driven by the drive roller 32.

As described above, the intermediate transfer unit 30 is a component obtained by forming the intermediate transfer belt 31, the drive roller 32, the tension roller 33, the primary transfer rollers 34 and the backup roller 35, the cleaning device 36, the support member 100 and the like into a unit. The intermediate transfer unit 30 is attached as the unit to the main body frame 200 of the image forming apparatus 1.

Next, how the intermediate transfer unit 30 is attached will be described.

As shown in FIG. 2, multiple pins extending in the rotation axis direction are provided to the intermediate transfer unit 30. Specifically, the intermediate transfer unit 30 has one front-side pin 111 provided at the front-side support member 101 so as to protrude toward the front-side, and two backside pins 112 provided at the backside support member 102 so as to protrude toward the backside as viewed in FIG. 1. Each of the front-side pin 111 and the backside pins 112 is a stepped columnar member.

The front-side pin 111 is provided at a position between the primary transfer roller 34 facing the photoconductive drum 12 of the image formation unit 11Y and the primary transfer roller 34 facing the photoconductive drum 12 of the image formation unit 11M in the horizontal direction as viewed in FIG. 1, and at an inner side position of the intermediate transfer belt 31 in the vertical direction.

The two backside pins 112 are configured of a right backside pin 112*a* provided on the right side and a left backside pin 112*b* provided on the left side as viewed in FIG. 1. The right backside pin 112*a* is provided on a side of the intermediate transfer unit 30 opposite to the front-side pin 111 with the intermediate transfer belt 31 interposed therebetween. The left backside pin 112*b* is provided at a position between the backup roller 35 and the tension roller 33 in the horizontal direction as viewed in FIG. 1 and at an inner side position of the intermediate transfer belt 31 and at the same height as that of the backup roller 35 in the vertical direction.

In addition, brackets 120 in which holes 121 are formed are secured to the front-side support member 101 at its left-side end portions in the horizontal direction as viewed in FIG. 1. Each bracket 120 protrudes upward from the top surface of the intermediate transfer belt 31 in the vertical direction as viewed in FIG. 1, and the hole 121 is formed in the protruding portion thereof. Each hole 121 is formed at a higher position than the backup roller 35 in the vertical direction as viewed in FIG. 1, and in the present exemplary embodiment, the hole 121 is formed at the same position as that of the backup roller 35 in the horizontal direction as viewed in FIG. 1.

FIG. 3 is a diagram showing an external appearance of the main body frame 200. FIG. 3 is a diagram showing the main body frame 200 as viewed in the same direction as FIG. 1.

The main body frame 200 has a front-side frame 201 in which an insertion hole 201*a* is formed, and a backside frame 202 provided at the backside thereof. The intermediate transfer unit 30 is inserted into the insertion hole 201*a*. A right backside-fitting hole 211 and a left backside-fitting hole 212 are formed in the backside frame 202. The right backside pin 112*a* (refer to FIG. 2) of the intermediate transfer unit 30 is fitted into right backside-fitting hole 211, and the left backside pin 112*b* thereof is fitted into the left backside-fitting hole 212.

A stick-shaped left front-side pin 221 is provided at the front-side frame 201. The hole 121 of the bracket 120 of the intermediate transfer unit 30 is formed with a size that allows the left front-side pin 221 to be loosely fitted into the hole 121.

Figure 4:
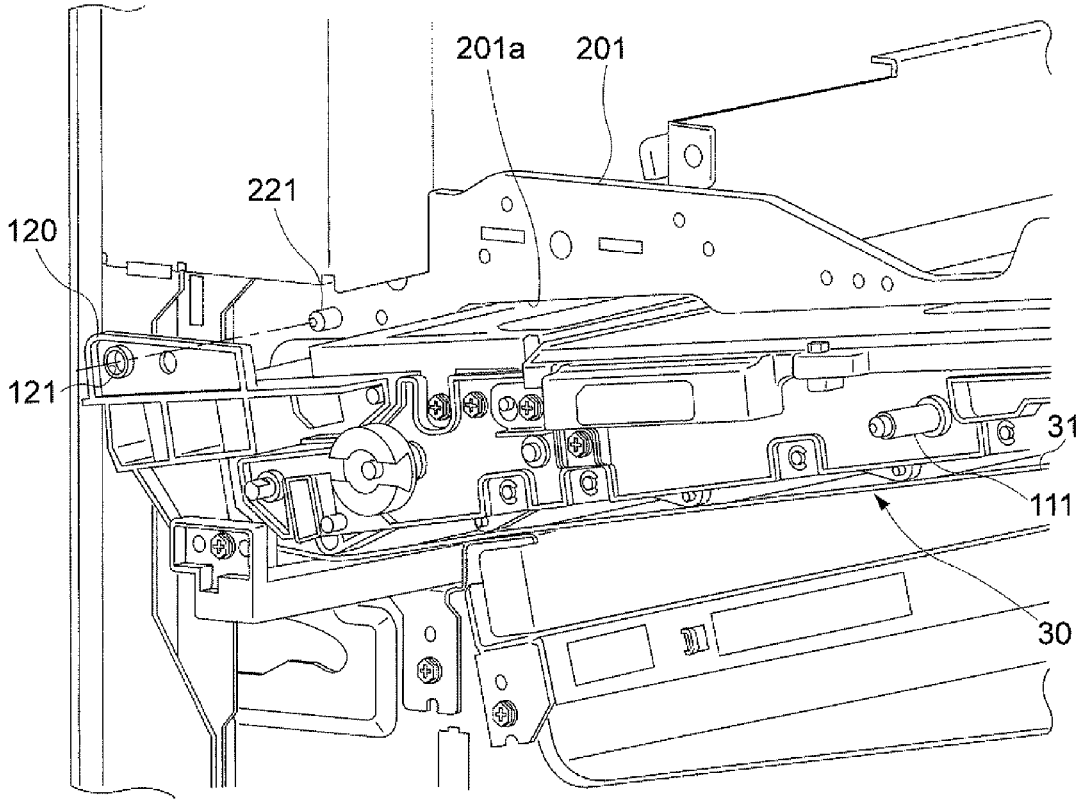
FIG. 4 illustrates a state before a hole on a bracket of the intermediate transfer unit is fitted over a left front-side pin of a front-side frame.
Figure 5:
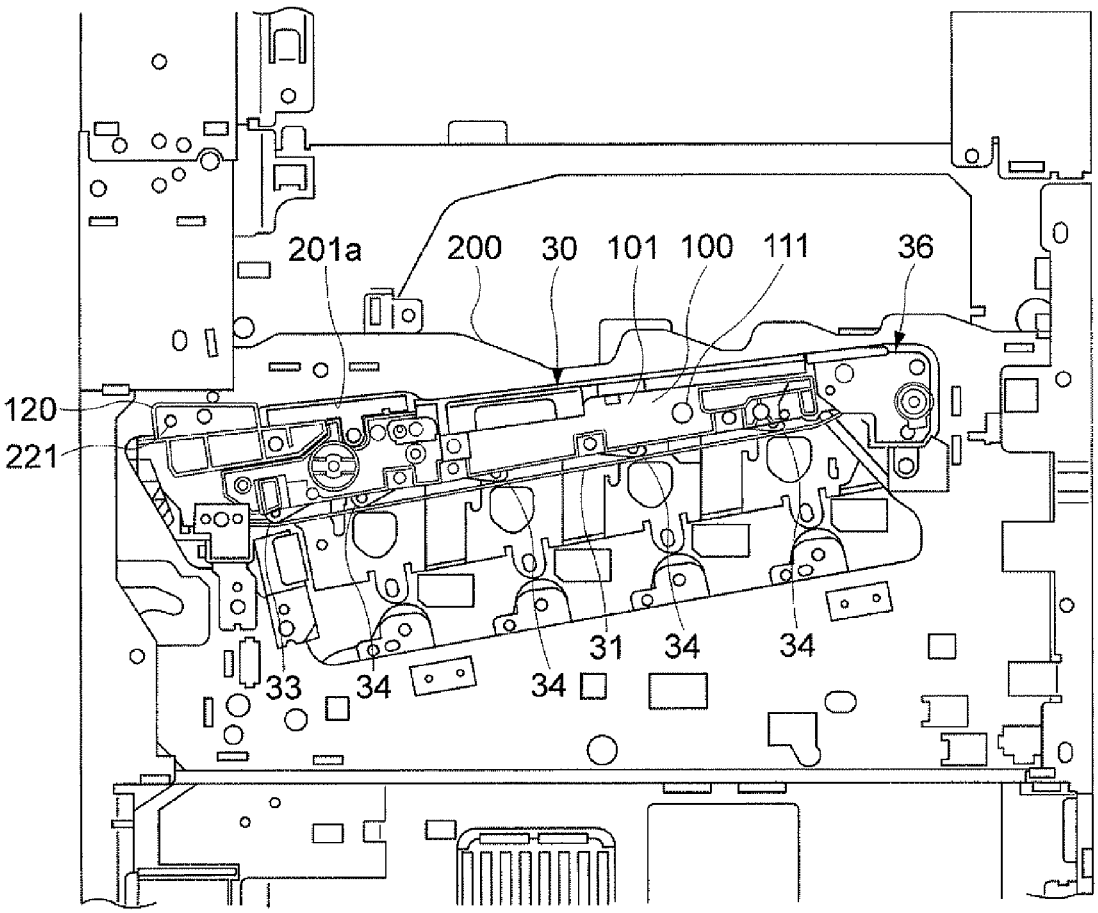
FIG. 5 illustrates a state where the intermediate transfer unit is fitted into the main body frame.

When the intermediate transfer unit 30 configured in the aforementioned manner is attached to the main body frame 200, the intermediate transfer unit 30 is inserted into the insertion hole 201*a* of the front-side frame 201 of the main body frame 200 from the front-side to the backside in the rotation axis direction while the side cover 45 is set to a opened state. At this time, the right backside pin 112*a* and the left backside pin 112*b* of the intermediate transfer unit 30 are fitted into the right backside-fitting hole 211 formed in the backside frame 202 of the main body frame 200 and the left backside-fitting hole 212 formed in the backside frame 202 thereof, respectively. Moreover, the hole 121 of the bracket 120 of the intermediate transfer unit 30 is fitted over the left front-side pin 221 of the front-side frame 201 of the main body frame 200. In this manner, the intermediate transfer unit 30 is positioned to the main body frame 200 while being supported at the three support points before the intermediate transfer unit 30 is secured to the main body frame 200. In other words, the right backside pin 112*a*, the right backside fitting hole 211, the left backside pin 112*b*, the left backside fitting hole 212, the left front-side pin 221 and the hole 121 of the bracket 120 function as an example of a positioning unit for positioning the intermediate transfer unit 30 when the intermediate transfer unit 30 is attached to the main body frame 200. FIG. 4 illustrates a state before the left front-side pin 221 of the front-side frame 201 is fitted into the hole 121 of the bracket 120 provided to the intermediate transfer unit 30. FIG. 5 illustrates a state where the intermediate transfer unit 30 is fitted to the main body frame 200.

Figure 6:
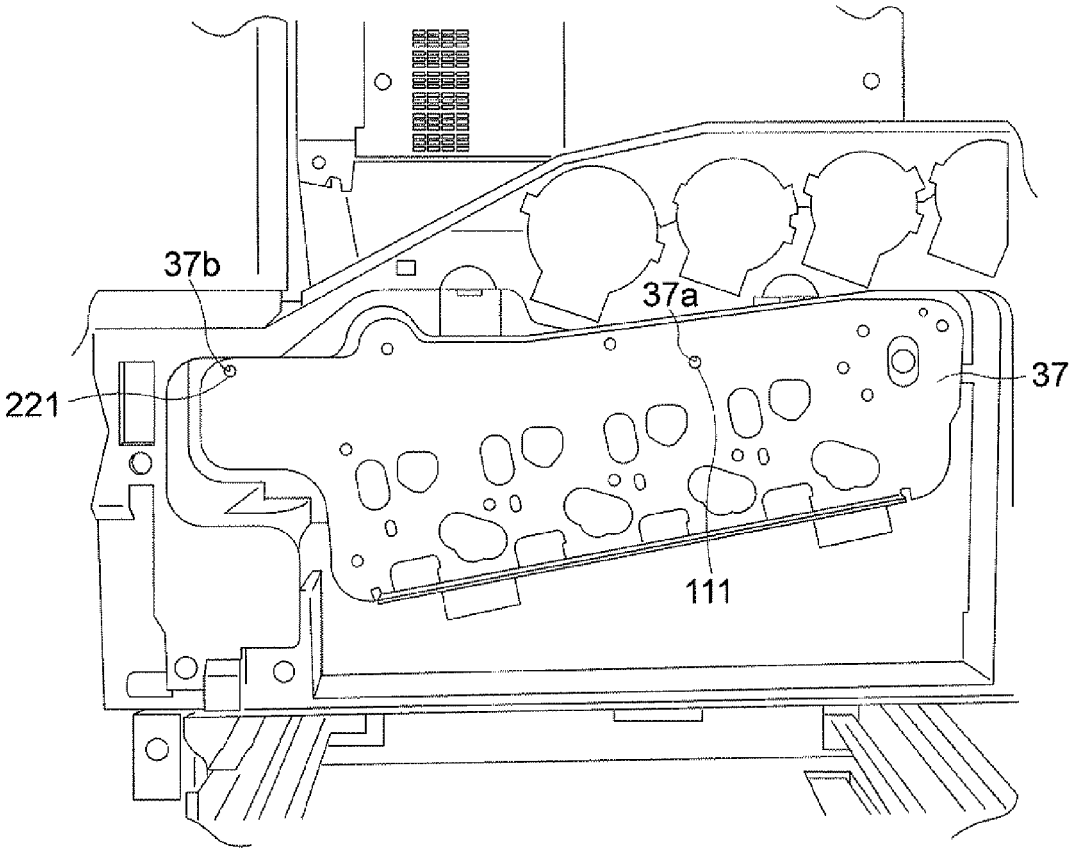
FIG. 6 illustrates a state where a front cover is secured to the main body frame.

FIG. 6 illustrates a state where the front cover 37 is secured to the main body frame 200.

After the intermediate transfer unit 30 is positioned by fitting the intermediate transfer unit 30 to the main body frame 200, that is, after the intermediate transfer unit 30 is attached to the main body frame 200, the front cover 37 is secured to the main body frame 200 by engaging a hook provided at the front cover 37 with a groove formed at the main body frame 200, or by using a bolt. Then, the intermediate transfer unit 30 positioned at the main body frame 200 is secured with respect to the main body frame 200 by securing the front cover 37 to the main body frame 200. More specifically, a right side hole 3'7*a* into which the front-side pin 111 of the intermediate transfer unit 30 is to be fitted, and a left side hole 37*b* into which the left front-side pin 221 of the front-side frame 201 of the main body frame 200 is to be fitted are formed in the front cover 37. Then, when the front cover 37 is secured to the main body frame 200, the right side hole 37*a* and the left side hole 37*b* are fitted over the front-side pin 111 of the intermediate transfer unit 30 and the left front-side pin 221 of the front-side frame 201 of the main body frame 200, respectively, while the front cover 37 is secured to the main body frame 200 by engaging a hook provided at the front cover 37 with a groove formed at the main body frame 200, or by use of a bolt or the like. In this manner, the front cover 37 is secured to the main body frame 200 while the intermediate transfer unit 30 is secured with respect to the main body frame 200.

When the front cover 37 is secured to the main body frame 200 and the intermediate transfer unit 30 is finally secured to the main body frame 200, the side cover 45 may be in the opened state or closed state.

In the case where the side cover 45 is caused to be in the closed state before the intermediate transfer unit 30 is secured to the main body frame 200 via the front cover 37, the intermediate transfer unit 30 is fitted to the main body frame 200, and thereafter, the side cover 45 is rotated in the clockwise direction as viewed in FIG. 1, then the side cover 45 is attached to the main body frame 200 while pressing the secondary transfer roller 41 against the backup roller 35.

After the intermediate transfer unit 30 is fitted to the main body frame 200 and the side cover 45 is attached to the main body frame 200, the front cover 37 is secured to the main body frame 200 by use of a bolt or the like. Consequently, even when the side cover is in the closed state, the intermediate transfer unit 30 is secured to the main body frame 200, as well as the front cover 37 is secured to the main body frame 200.

If the intermediate transfer unit 30 is displaced from a normal position predetermined as a securing position of the intermediate transfer unit 30 in a stage prior to securing the intermediate transfer unit 30 to the main body frame 200 via the front cover 37 because the intermediate transfer unit 30 is pressed by the secondary transfer unit 40, it is needed to secure the front cover 37 while moving the intermediate transfer unit 30 toward the normal position, that is, pressing the surface of the secondary transfer roller 41 with the surface of the intermediate transfer belt 31 against the secondary transfer unit 40.

In the image forming apparatus 1 of the present exemplary embodiment configured as described above, before being finally secured to the main body frame 200 via the front cover 37, the intermediate transfer unit 30 is supported by the main body frame 200 at three supporting points, namely, two backside pins 112 located at the backside and the hole 121 of the front-side bracket 120 as viewed in FIG. 1, to be positioned. Therefore, as attention is focused on the case where the front cover 37 is secured while the side cover 45 is in the closed state, an amount of positional displacement of the intermediate transfer unit 30 when the backup roller 35 of the intermediate transfer unit 30 is pressed by the secondary transfer roller 41 is less than an amount of positional displacement when the backup roller 35 is pressed by the secondary transfer roller 41, for example, in a state where the intermediate transfer unit 30 is supported by the main body frame 200 at two points, namely, the backside pins 112 located at the backside. In other words, in the present exemplary embodiment, since the intermediate transfer unit 30 is supported on the secondary transfer unit 40 side by at least two points which are different in the rotation axis direction when the intermediate transfer unit 30 is attached (fitted) to the main body frame 200, the amount of positional displacement of the intermediate transfer unit 30 from the normal position is reduced in comparison with a configuration such that the intermediate transfer unit 30 on the secondary transfer unit 40 side is not supported on the main body frame 200 by the at least two points before being secured via the front cover 37. Accordingly, a force required to finally secure the intermediate transfer unit 30 to the main body frame 200 via the front cover 37 is less than a force, for example, required to support the intermediate transfer unit 30 on the main body frame 200 by two points, namely, two backside pins 112 located at the backside, and then finally secure the intermediate transfer unit 30 to the main body frame 200 while correcting the positional displacement by the front cover 37.

Further, in the present exemplary embodiment, when the intermediate transfer unit 30 is positioned with respect to the main body frame 200, the secondary transfer unit 40 side of the intermediate transfer unit 30 is supported at least at two points differently located in the rotation axis direction. Therefore, the amount of positional displacement of the intermediate transfer unit 30 from the normal position is reduced in comparison with the configuration such that the secondary transfer unit 40 side of the intermediate transfer unit 30 is not supported on the main body frame 200 at least at two points before being secured via the front cover 37. Consequently, in the case where the secondary transfer unit 40 is brought into contact with the intermediate transfer unit 30 configured as in the present exemplary embodiment, an amount of movement of the intermediate transfer unit 30 caused by the contact is small. Thereby, a force required to bring the secondary transfer unit 40 into contact with the intermediate transfer unit 30, and friction between the surfaces of the secondary transfer unit 40 and the intermediate transfer unit 30 that occurs as the intermediate transfer unit 30 moves may be suppressed in comparison with the configuration such that the secondary transfer unit 40 side of the intermediate transfer unit 30 is not supported on the main body frame 200 at least at two points.

The final position of the intermediate transfer unit 30 secured to the main body frame 200 via the front cover 37 is less likely to be displaced from the normal position in the case where the intermediate transfer unit 30 is positioned with respect to the main body frame 200 at the three points as the intermediate transfer unit 30 in the present exemplary embodiment in comparison with, for example, the configuration such that the intermediate transfer unit 30 is positioned with respect to the main body frame 200 at the two points, namely, the backside pins 112 located at the backside. Thus color misregistration in an image formed on a sheet, which is caused by displacement of the attached intermediate transfer unit 30 from the normal position, may be suppressed.

Further, the intermediate transfer unit 30 of the present exemplary embodiment is, before being finally secured to the main body frame 200 via the front cover 37, supported on the main body frame 200 at the three points, namely, the backside pins 112 located at the backside and the hole 121 of the front-side bracket 120, while the right front-side part thereof is not supported on the main body frame 200. However, the position of the left front-side part of the intermediate transfer unit 30 which is supported is above the backup roller 35, where a moment occurs around the supported left front-side part due to a contact force between the backup roller 35 and the secondary transfer roller 41 so that the not-supported right front-side part is moved upwardly. Therefore, the right front-side part of the intermediate transfer unit 30 which is not supported descends due to its own weight. Meanwhile, the intermediate transfer unit 30 receives a moment in the counterclockwise direction as viewed in FIG. 1, caused by the secondary transfer roller 41 pressing the backup roller 35, and the right front-side part of the intermediate transfer unit 30 moves upwardly. As a result, the amount of positional displacement of the right front-side part of the intermediate transfer unit 30 from the normal position is small though the part is not supported. Accordingly, the force required to finally secure the intermediate transfer unit 30 to the main body frame 200 via the front cover 37 and the amount of displacement of the final position of the intermediate transfer unit 30 from the normal position are both small when compared to, for example, the case where the support position (the support) of the left front-side of the intermediate transfer unit 30 is lower than the backup roller 35.

Since the main body frame 200 supports the intermediate transfer unit 30 even in a state where the front cover 37 is opened, effects of the intermediate transfer unit 30 on each of the image forming units 11, which are positioned below the intermediate transfer unit 30, when being attached to or detached from the main body frame 200 may be suppressed in comparison with the configuration such that the secondary transfer unit 40 side of the intermediate transfer unit 30 is not supported on the main body frame 200 at least at two points.

In the above-described exemplary embodiment, two backside pins 112 are provided at the backside of the intermediate transfer unit 30 to be fitted into the right backside fitting hole 211 and the left backside fitting hole 212 formed on the backside frame 202 of the main body frame 200. However, two pins may be alternatively provided to the backside frame 202 of the main body frame 200 and fitted into holes formed on the backside support member 102 of the intermediate transfer unit 30.

Further, in the above-described exemplary embodiment, the hole 121 on the bracket 120 of the intermediate transfer unit 30 and the left side hole 37*b* on the front cover 37 are fitted over the left front-side pin 221 on the front-side frame 201 of the main body frame 200. However, two stick-shaped pins protruding in the rotation axis direction may be provided to the front-side frame 201 of the main body frame 200, over one of which the hole 121 on the bracket 120 of the intermediate transfer unit 30 is fitted, and over the other one of which the left side hole 37*b* on the front cover 37 is fitted.

As in the above-described exemplary embodiment, when attaching the intermediate transfer unit 30 to the main body frame 200, positioning of the intermediate transfer unit 30 may be performed by three-point support by use of the right backside pin 112*a*, the right backside fitting hole 211, the left backside pin 112*b*, left backside fitting hole 212, left front-side pin 221 and the hole 121 on the bracket 120. However, the present invention is not limited thereto. The secondary transfer unit 40 side of the intermediate transfer unit 30 may be supported at least at two points which are differently located in the rotation axis direction.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The exemplary embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier that carries an image;

an intermediate transfer unit including a belt-like intermediate transfer body onto which the image formed on the image carrier is transferred, and a plurality of rotation members around which the intermediate transfer body is wound, each of the plurality of rotation members rotating around a rotation axis, the intermediate transfer unit being detachably attached, in a direction of the rotation axis of each of the plurality of rotation members, to an apparatus main body;

a secondary transfer unit that transfers the image on the intermediate transfer body onto a recording medium and makes contact with and separates from the intermediate transfer body, the secondary transfer unit being provided at an opposite side of the plurality of rotation members with the intermediate transfer body interposed therebetween, the secondary transfer unit being provided to the apparatus main body;

a positioning unit that, before the intermediate transfer unit is secured to the apparatus main body, positions the intermediate transfer unit to the apparatus main body in the secondary transfer unit side at least at two points differently located in the rotation axis direction of the plurality of rotation members; and a securing unit that secures the intermediate transfer unit positioned by the positioning unit to the apparatus main body even in the state where the intermediate transfer body and secondary transfer unit are brought into contact with each other.

2. The image forming apparatus according to claim 1, wherein the plurality of rotation members of the intermediate transfer unit includes a facing member that faces the secondary transfer unit with the intermediate transfer body interposed therebetween and a non-facing member that does not face the secondary transfer unit, the positioning unit positions a part of the intermediate transfer unit, which is located on a backside in the rotation axis direction of the plurality of rotation members compared to the intermediate transfer body, and another part of the intermediate transfer unit, which is located on a front side in the rotation axis direction of the plurality of rotation members compared to the intermediate transfer body, and closer to the non-facing member rather than the facing member, the securing unit secures the part of the intermediate transfer unit, which is located on the front side in the rotation axis direction of the plurality of rotation members compared to the intermediate transfer body and closer to the non-facing member rather than the facing member, and the secondary transfer unit makes contact with or separates from the intermediate transfer body irrespective of the securing operation by the securing unit.

3. The image forming apparatus according to claim 1, wherein the positioning unit positions a part of the intermediate transfer unit, which is located on the backside in the rotation axis direction compared to the intermediate transfer body at two points, and another part of the intermediate transfer unit, which is located on the front side in the rotation axis direction compared to the intermediate transfer body at one point.

4. The image forming apparatus according to claim 2, wherein the positioning unit positions the part of the intermediate transfer unit, which is located on the backside in the rotation axis direction compared to the intermediate transfer body at two points, and another part of the intermediate transfer unit, which is located on the front side in the rotation axis direction compared to the intermediate transfer body at one point.

5. The image forming apparatus according to claim 3, wherein another part of the intermediate transfer unit to be positioned with respect to the apparatus main body by the positioning unit, which is located on the front side compared to the intermediate transfer body is located above a part where the secondary transfer unit and the facing member face each other.

6. The image forming apparatus according to claim 4, wherein another part of the intermediate transfer unit to be positioned with respect to the apparatus main body by the positioning unit, which is located on the front side compared to the intermediate transfer body is located above a part where the secondary transfer unit and the facing member face each other.

7. The image forming apparatus according to claim 3, wherein another part of the intermediate transfer unit to be positioned with respect to the apparatus main body by the positioning unit, which is located on the front side compared to the intermediate transfer body is on a position such that a moment, occurring around the part located on the front side due to a contact force between the secondary transfer unit and the intermediate transfer body when the secondary transfer unit and the intermediate transfer body are brought into contact with each other, moves the part of the intermediate transfer unit secured by the securing unit upwardly.

8. The image forming apparatus according to claim 4, wherein another part of the intermediate transfer unit to be positioned with respect to the apparatus main body by the positioning unit, which is located on the front side compared to the intermediate transfer body is on a position such that a moment, occurring around the part located on the front side due to a contact force between the secondary transfer unit and the intermediate transfer body when the secondary transfer unit and the intermediate transfer body are brought into contact with each other, moves the part of the intermediate transfer unit secured by the securing unit upwardly.

9. The image forming apparatus according to claim 5, wherein another part of the intermediate transfer unit to be positioned with respect to the apparatus main body by the positioning unit, which is located on the front side compared to the intermediate transfer body is on a position such that a moment, occurring around the part located on the front side due to a contact force between the secondary transfer unit and the intermediate transfer body when the secondary transfer unit and the intermediate transfer body are brought into contact with each other, moves the part of the intermediate transfer unit secured by the securing unit upwardly.

10. The image forming apparatus according to claim 6, wherein another part of the intermediate transfer unit to be positioned with respect to the apparatus main body by the positioning unit, which is located on the front side compared to the intermediate transfer body is on a position such that a moment, occurring around the part located on the front side due to a contact force between the secondary transfer unit and the intermediate transfer body when the secondary transfer unit and the intermediate transfer body are brought into contact with each other, moves the part of the intermediate transfer unit secured by the securing unit upwardly.

11. The image forming apparatus according to claim 1, wherein the positioning unit positions the intermediate transfer unit to the apparatus main body in the secondary transfer unit side at least at two points differently located in the rotation axis direction of the plurality of rotation members when the intermediate transfer unit is in an imaging position.

* * * * *